United States Patent [19]

Tokizane et al.

[11] Patent Number: 5,000,910

[45] Date of Patent: Mar. 19, 1991

[54] METHOD OF MANUFACTURING INTERMETALLIC COMPOUND

[75] Inventors: Masaharu Tokizane, Osagicho 6, Iwakuraminami, Sakyo-ku, Kyoto-shi, Kyoto; Kei Ameyama, Otsu; Haruhiko Sugimoto, Osaka, all of Japan

[73] Assignees: Masaharu Tokizane, Kyoto; Siro Hagishita, Hyogoken, both of Japan

[21] Appl. No.: 469,631

[22] Filed: Jan. 24, 1990

[30] Foreign Application Priority Data

Jan. 24, 1989 [JP] Japan ..... 1-15883

[51] Int. Cl.[5] ..... C21D 1/00

[52] U.S. Cl. ..... 419/29; 419/33; 419/39; 419/48; 419/57

[58] Field of Search ..... 419/33, 29, 39, 48, 419/57

[56] References Cited

U.S. PATENT DOCUMENTS 4,668,470 5/1987 Gilman et al. ..... 419/32

4,761,263 8/1988 Politis et al. ..... 419/33

*Primary Examiner*—Stephen J. Lechert, Jr.

*Attorney, Agent, or Firm*—Felfe & Lynch

[57] ABSTRACT

At least two kinds of element metal or half-metal powders are mechanically alloyed in a non-oxidizing atmosphere in a blending machine. Then, the resultant mechanically alloyed powdered blend is heated and pressurized in the non-oxidizing atmosphere at a temperature higher than a minimum temperature required for generating the intermetallic compound from the element powders.

12 Claims, 6 Drawing Sheets

METHOD OF MANUFACTURING INTERMETALLIC COMPOUND

FIELD OF INVENTION

The present invention relates to a method of manufacturing an intermetallic compound using powdered material.

DESCRIPTION OF THE PRIOR ART

In recent year, intermetallic compounds have attracted increasing public attention for their distinguished properties promising as new metallic materials, and varied research and development activities have been conducted to seek industrial applications of such intermetallic compounds. Indeed, intermetallic compounds are distinguished in such physical or chemical properties as high-temperature strength, heat resistance and corrosion resistance.

Conventionally, for manufacturing an intermetallic compound, with reference to an alloy phase diagram, predetermined amounts (that is, amounts according to a target toichiometric composition) of at least two kinds of powdered metal (or semi-metal) elements are blended and melted in an appropriate melting device. Then, the melted blend is cast to obtain an intermetallic compound product.

However, if the intermetallic compound is manufactured by such conventional casting method, there inevitably occur unfavorable phenomena such as formation of blow holes due to gaseous contents included in the metal elements, structural defect due to inadvertent non-metallic inclusion, oxidation and segregation.

In view of the above-described problem of the prior art, the primary object of the present invention is to provide an improved method of manufacturing an intermetallic compound which can overcome the above problem and can readily provide a homogeneous intermetallic compound.

SUMMARY OF THE INVENTION for accomplishing the above-noted object, at least two kinds of element metal powders are mechanically alloyed in a non-oxidizing atmosphere in a blending machine. the mechanically alloyed powdered blend is heated and pressurized in the non-oxidizing atmosphere at a temperature higher than a minimum temperature required for generating the intermetallic compound from the element powders.

The blending machine used in the above mechanical alloying step can vary conveniently. If a ball mill is used as this blending machine, it is particularly advantageous if the weight ratio between the balls of the ball mill and the element powders exceeds 50 : 1.

further, according to one preferred embodiment of the present invention, the obtained sintered material is annealed at a temperature higher than the sintering temperature. this annealing treatment can further improve the mechanical properties of the sintered material.

According to another preferred mode of the present invention, the element powders comprise two selected from the group consisting of Al, Mo, Nb, Ni, Si, Ti and W. With this selection, the intermetallic compound will be more useful for various applications.

Functions and effects of the above-described method of the invention will be particularly described next.

Because the non-oxidizing atmosphere is employed in the mechanical alloying step of more than two kinds of element powders, no oxidation occurs in the element powders and the obtained blend has a very homogeneous mixture phase. Further, unlike the conventional casting method, there occurs no segregation in the compound, either.

Incidentally, what is referred to herein as the mechanical alloying treatment is commonly known as the MA method (Mechanical Alloying Method) in which more than two kinds of element powders are blended at a blending machine for causing solid phase diffusion therein. The non-oxidizing atmosphere generically refers to any atmosphere such as vacuum atmosphere or atmosphere filled with $N_2$ gas and an inert gas such as Ar, He gas in which oxidation hardly occurs.

Then, the resultant mechanically alloyed powdered blend comprised of the mixture phase is heated and pressurized by means of e.g. a hot-press to generate an intermetallic compound comprised of a single phase of a predetermined stoichiometric composition, alternately a structure in which two or more than two phases including non-stoichiometric composition co-exist. With the above method of the invention, the resultant intermetallic compound is a homogeneous and reinforced sintered material having distinguished mechanical properties and superfine grain size. Thus, this intermetallic compound is usable as so-called, super-plastic material.

Advantageously, the heating-pressurizing step of the mechanically alloyed blend is effected at an elevated temperature higher than the minimum temperature required for forming the intermetallic compound of this mixture phase. The extra temperature can assure reliable fabrication of the target intermetallic compound comprised of high-density sintered material. The structure of the intermetallic compound can be comprised of either single phase or more than two phases including non-stoichiometric composition co-existent with the stoichiometric composition. In some occasions, such two phase structure can achieve even better properties due to combination of the properties of the respective intermetallic compound phases.

Further, for obtaining sintered material of even higher density, the pressure applied in the pressurizing step should exceed 100 MPa.

In case a ball mill is employed as the blending machine, the weight ratio between the balls of the mill and the element metal powders to be charged therein should exceed 50 : 1 for better promoting solid phase diffusion, i.e. alloying process. However, if the ratio is extended excessively, there will occur disadvantageous reduction in the yield of the powderly blend.

If the sintered material is annealed at a temperature higher than the sintering temperature, this annealing process can further promote solid phase diffusion to render the structure of the sintered material uniform and also to promote appropriate growth of grain size in the sintered material. Accordingly, the sintered material through this additional annealing process can acquire further improved mechanical properties, in particular, its ductility, which properties can advantageously extend the applications of the material.

If the element powders comprise two selected from the group consisting of Al, Mo, Nb, Ni, Si, Ti and W, such intermetallic compounds as $Ni_3Al$, NiAl, $Ti_3Al$, TiAl, $MoSi_2$, $WSi_2$, $Nb_3Al$ can be generated. These kinds of intermetallic compounds are superior in high temperature strength, heat resistance and corrosion resistance. Accordingly, the final products formed of these intermetallic compounds will find an extended field of applications.

Further, some intermetallic compounds have upper and lower deviations in their stoichiometric compositions, and in some cases, compounds with such deviations can achieve superior mechanical properties to those without the deviations. Then, according to the present invention, it is fairly easy to produce such compound merely by appropriately adjusting the proportions of the element metal powders for the mechanical alloying treatment.

It is also conceivable to generate a sintered material by combining more than two kinds of mechanically alloyed powdered blends so that the combination may advantageously improve the properties of the sintered material.

For instance, if the intermetallic compound comprised basically of Ti-Al includes e.g. $Ti_3$ Al, $Al_3$ Ti phase in addition, the combination can further improve the mechanical properties of the compound.

The prior art has suggested that solid solution addition of a third element such as Mn, Nb, or the like by a small amount can improve the ductility of the intermetallic compound such as TiAl and $Ti_3$ Al. In this case, according to the method of the present invention, the addition of the third element takes place at the initial stage of the mechanical alloying process. In this way, the method of the present invention can be advantageously utilized in such case as well. similarly, it is also conceivable to add a further pure metal powder(s) to the compound as a fourth element and a fifth element.

The intermetallic compound obtained by the method of the present invention can be used in a great variety of mechanical parts, in particular, for heavy duty use such as a high-temperature resistant exterior material, e.g. high-speed turbine blades and so on.

further and other objects, features and effects of the invention will become apparent from the following more detailed description of the embodiments of the invention with reference to the accompanying drawings.

BRIEF DESCRIPTION OF THE DRAWINGS

Accompanying drawings FIGS. 1 through 9 illustrate a method of manufacturing an intermetallic compound relating to the present invention; in which, FIG. 1 is an X-ray diffraction pattern of mechanically alloyed powdered blend, FIGS. 2(*a*) and 2(*b*) are an SEM micrograph of particles constituting the powdered blend and an SEM micrograph showing a cross section of one of the particles, respectively.

FIG. 3 is a system view illustrating a heating-pressurizing process of the alloyed blend, FIG. 4 is a TEM micrograph of sintered material obtained through the heating-pressurizing treatment of the alloyed blend, FIG. 5 is a graph of true stress-true strain rate curves, FIG. 6 is a TEM micrograph of sintered material after compressive deformation, FIG. 7 is an X-ray diffraction pattern of the sintered material, FIG. 8 is a TEM micrograph of the sintered material after heating process, and FIG. 9 is a graph of true stress-true strain curves of various sample materials used in an experiment.

DESCRIPTION OF THE PREFERRED EMBODIMENTS

First, at least two kinds of elements metal powders, as constituent elements of a target intermetallic compound, are blended in a proportion appropriate for fabricating the target compound. Then, this blend is mechanically alloyed for a predetermined time period in a non-oxidizing atmosphere in a mixing machine such as a ball mill so as to promote solid phase diffusion occuring in the blend. The ball mill can be substituted by other mixing machines such as a vibration mill or an high-energy attritor.

The high-energy attritor is especially advantageous for promoting the mixing and stirring of the element metal powders and the solid phase diffusion therebetween and consequently for significant reduction in the processing time period.

Next, the resultant mechanically alloyed blend is subjected to a heating-pressurizing process to generate an intermetallic compound, with the heating temperature being higher than a minimum temperature required for generating an intermetallic compound having the stoichiometric composition formable from this powder mixture. The intermetallic compound resulting from the above process comprises the so-called near-net shape type which has a shape approximating that of a final product. Therefore, the above method is advantageous for achieving a high yield, i.e. high productivity.

The abvove heating-pressurizing process can be most commonly effected by means of a hot-press. However, other means such as a hot isostatic pressing unit (HIP) can be employed also for the sintering purpose.

One sample experiment will be described next.

SAMPLE EXPERIMENT to obtain a stoichiometric composition: Ti—36 wt % Al (Ti—50 at % Al), pure Ti element powder and pure Al element powder were prepared by appropriate amounts, respectively. These element powders were charged into a ball mill filled with argon atmosphere and the powders were blended and milled therein to promote solid phase diffusion in the blend. The weight ratio between the balls of the ball mill and the element powders was set at 60 : 1 and the rotational velocity of the mill was set at 90 rpm.

Figure 1:
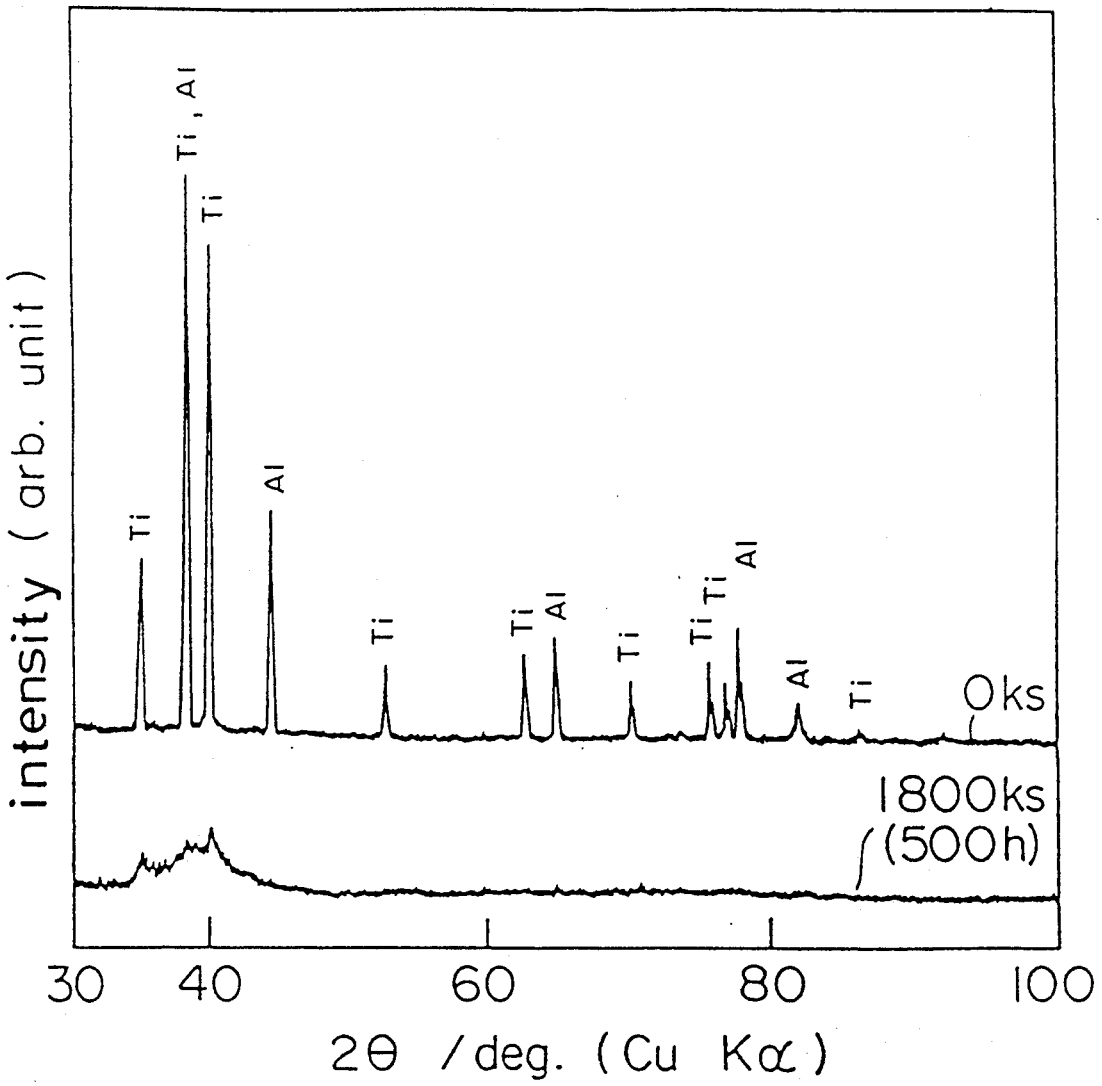
Figure 2A:
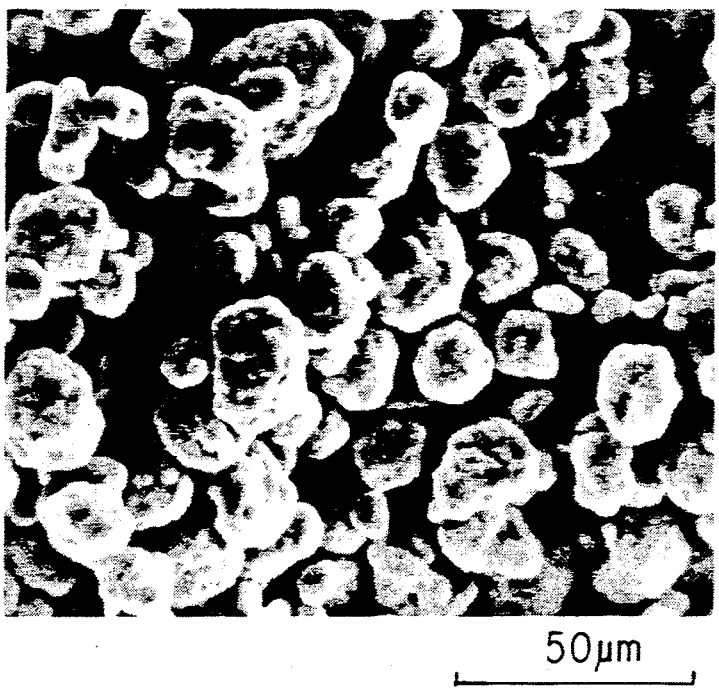
Figure 2B:
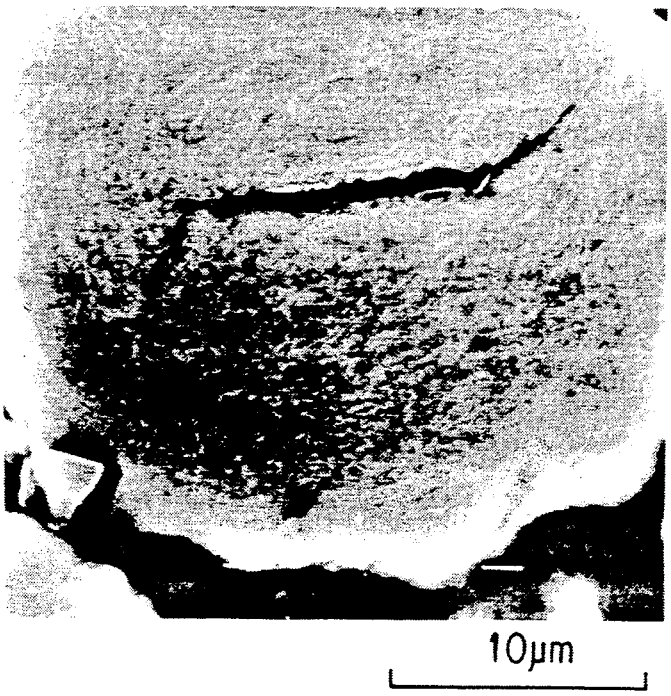

The above mill operation was continued for 500 hours. FIG. 1 is an X-ray diffraction pattern of the resultant mechanically alloyed, powdered blend. FIGS. 2(*a*) and 2(*b*) are a TEM micrograph of particles constituting the mechanically alloyed blend and a TEM micrograph showing a cross section of one particle obtained by a scanning electronic microscope (SEM), respectively. Referring to FIG. 1, generation of TiAl alloy phase (including non-crystalline phase, amorphous) is proven as the resultant blend shows lower peak values in the X-ray driffraction intensity than those of the respective Ti element powder and Al element powder before the mechanical alloying process. Also, FIGS. 2(*a*) and 2(*b*) show approximately homogeneous shapes and structure of the constituent particles in the blend.

Figure 3:
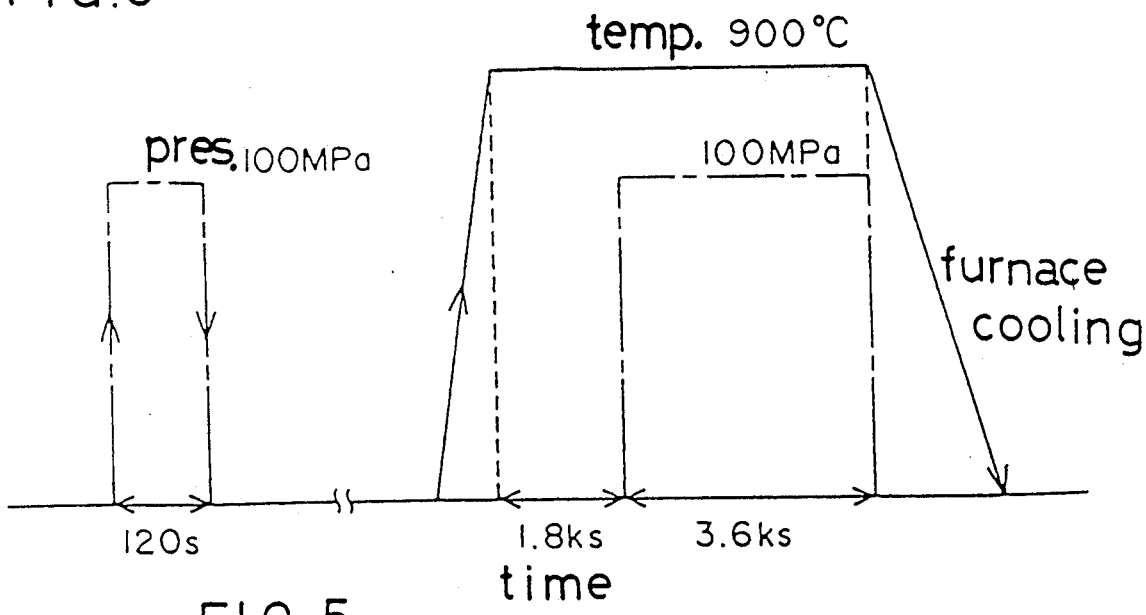

Next, the above powdered blend was charged into a hot-press. In the hot-press, the blend was subjected to a preliminary pressurizing process for about 2 minutes at 100 MPa and then to a heating process continued for 30 minutes at about 900 degrees in Celsius which temperature is higher than the minimum temperature for generating equilibrium phase of TiAl. Thereafter, a main pressurizing treatment was continuously effected for 1 hour at 100 MPa. The resultant blend was treated as shown in a graph of FIG. 3.

Figure 4:
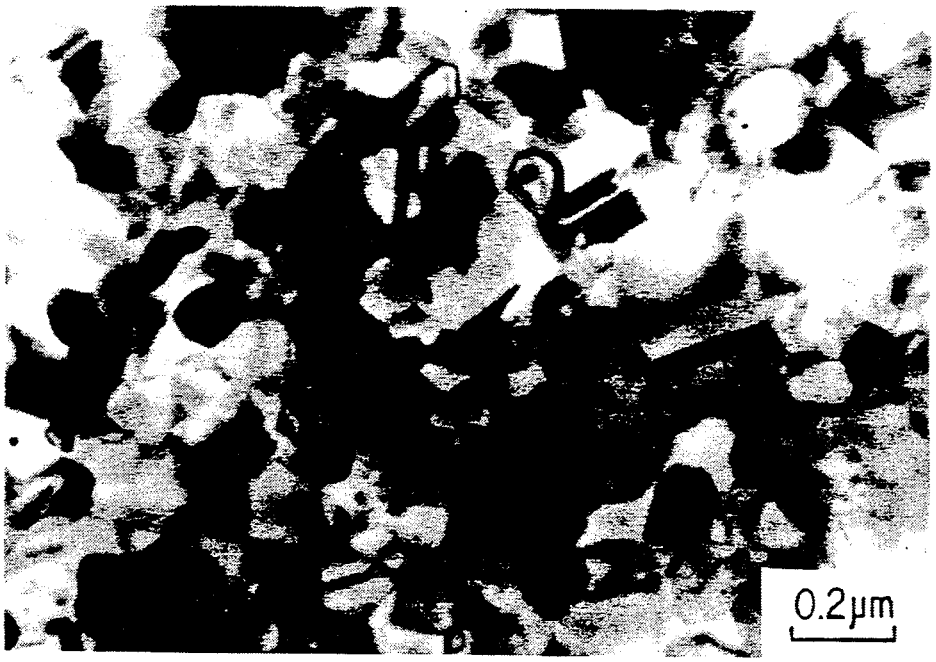

The above heating process was conducted in a vacuum atmosphere so as to avoid oxidation. After the main heating treatment and furnace cooling, the blend was annealed to form an alloy product.

thus produced alloy proved a reinforced sintered material having a mutal density higher than 99.8 %.

further, the average grain diameter of the resultant sintered material was as amall as 0.1 μm. FIG. 4 is a TEM micrograph of a structure of the sintered material obtained through a transmission electron microscope.

Figure 5:
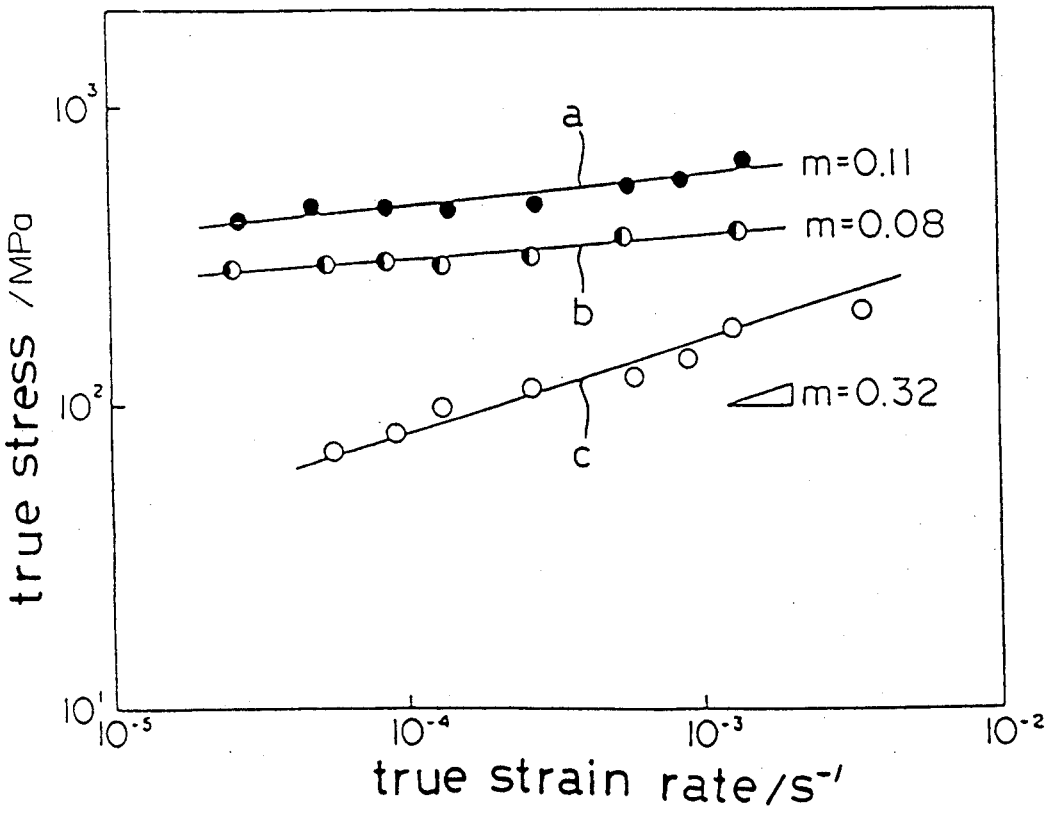
Figure 6:
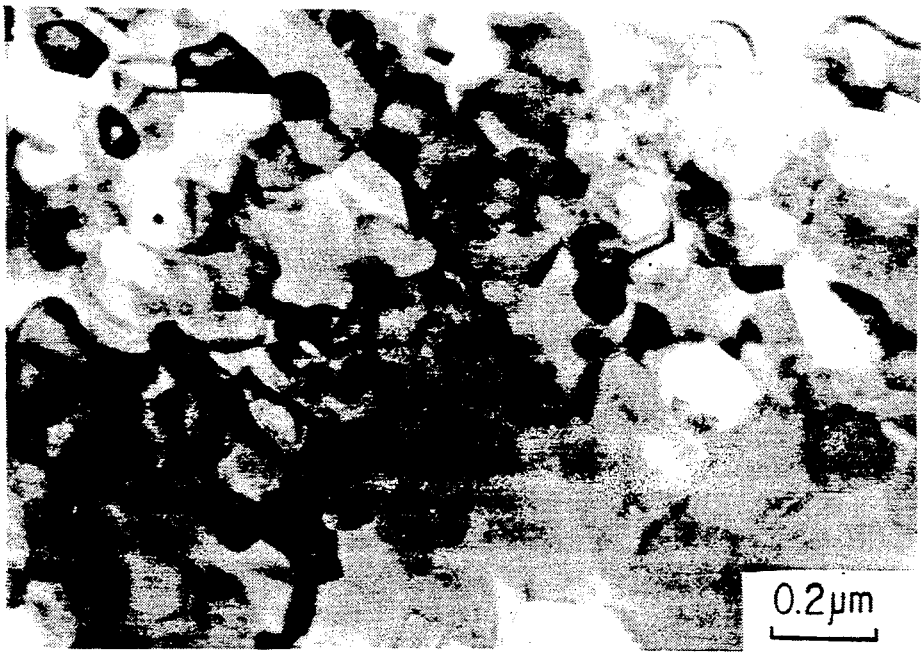

Next, the superplastic property of this sintered material was tested. More particularly, as sample materials for comparison, TiAl intermetallic compound (a) generated by the conventional casting method and a further TiAl intermetallic compound (b) prepared by heating the material (a) for 5 hours at 1,200 degrees in Celsius were prepared. And, these sample materials (a) and (b) were compared with the sintered material (c) of the invention to obtain respective true stress vs. true strain curves, as illustrated in a graph of FIG. 5. As shown, the invention's sintered material (c) has a slope (strain-rate sensitivity exponent: to be referred to as 'm' value h ereinafter) of 0.32 which is more than about three times greater than the 'm' value: 0.11 of the sample material (a) and the 'm' value: 0.08 of the other sample material (b). This means that the invention's sintered material (c) has superior superplastic property.

further, this sintered material (c) was caused to undergo 21 % compression (reduction in height) process at 900 degrees in Celsius with an initial strain rate: $3.6\times10^{-5}$ $s^{-1}$. Then, metallic structure of this compressed material was observed through the transmission type electronic microscope. The observed structure is shown in a TEM micrograph of FIG. 6.

Despite the 21 % compression, each of the grains of the material retained non-flat shape. It was concluded, therefore, that the deformation of the sintered material due to the 21 % compression had taken place due to super plastic fluidity attributable to mutual sliding motions of the grains through their peripheries.

Figure 7:
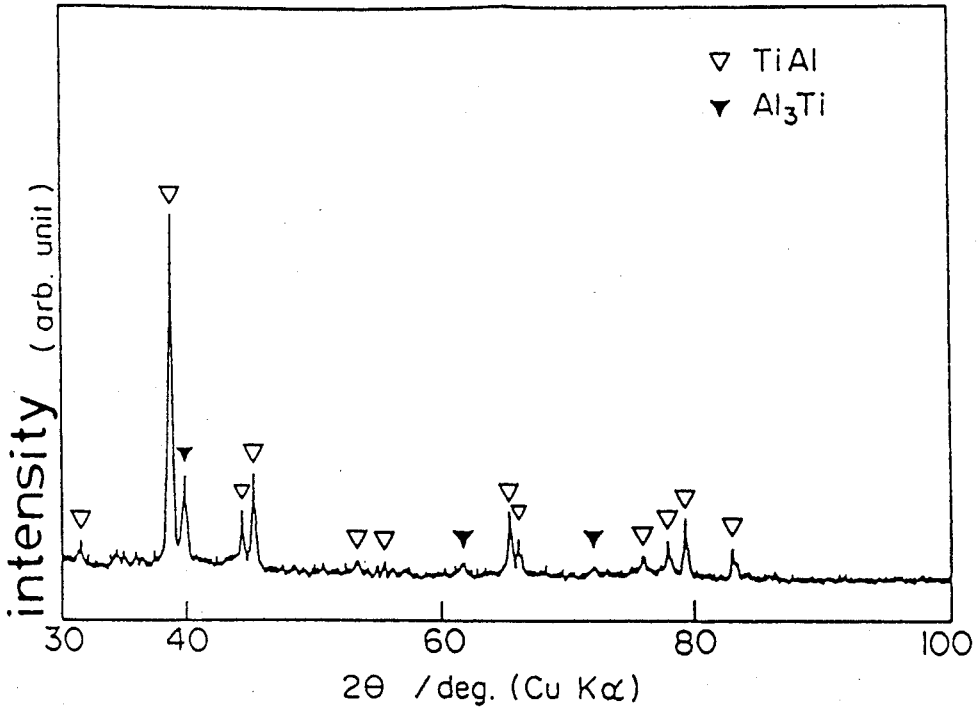

FIG. 7 is a TEM micrographic view of the above sintered material. As shown, the sintered material is comprised mostly of TiAl phase, but additionally includes a small amount of $Al_3$ Ti phase.

Figure 9:
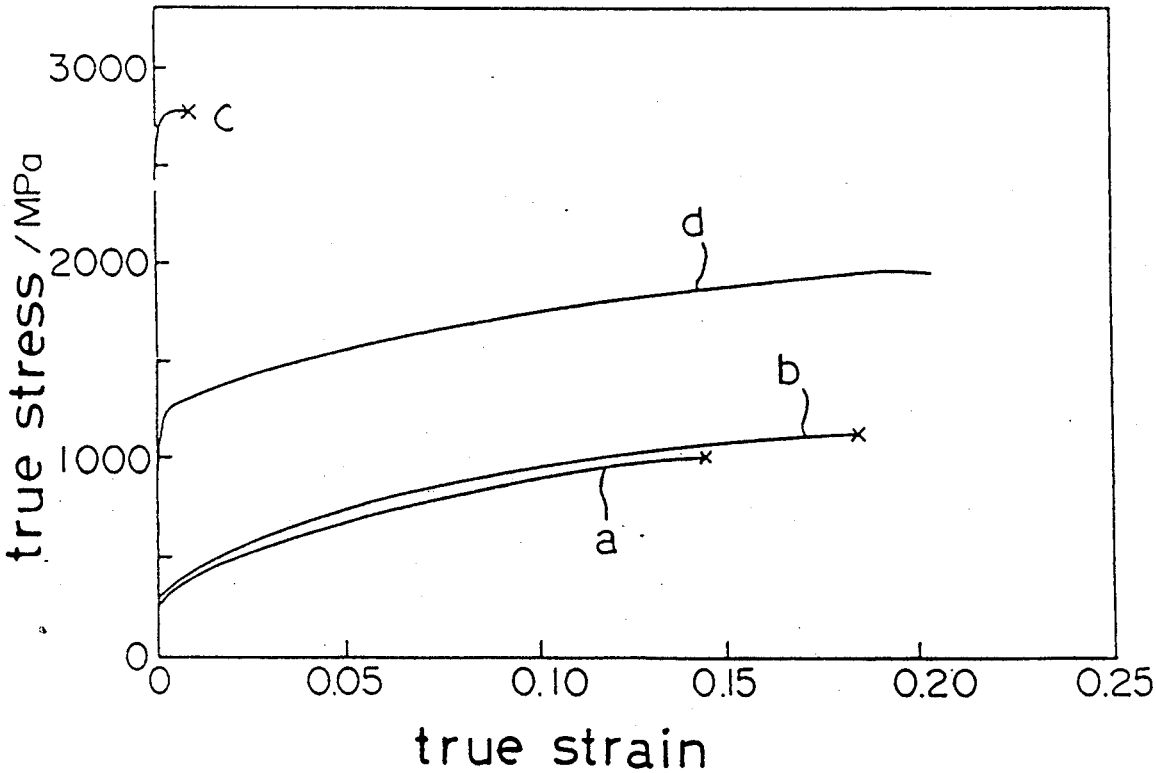
Figure 8:
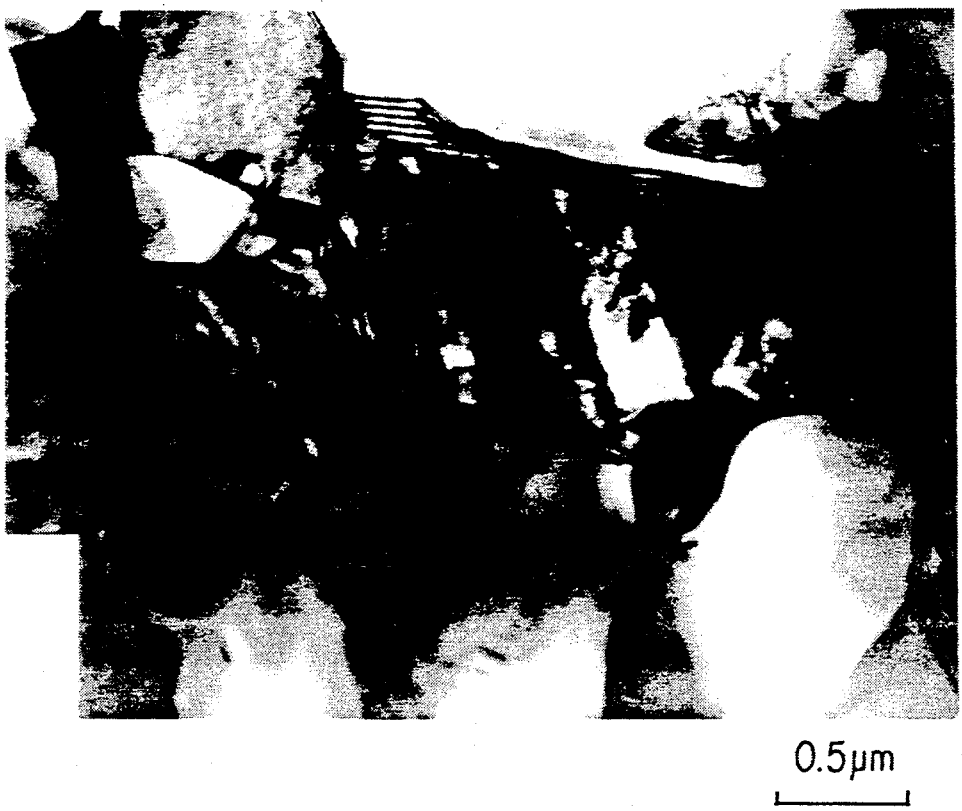

Next, the invention's sintered material (c) was heated for ten hours at 1,200 degrees in Celsius in order to further promote its solid phase diffusion, matrix homogenization and further grain growth up to 1 to 2 μm. The resultant material (d) showed significant improvement in its ductility although its stress resistance was observed to have slightly deteriorated. FIG. 8 is a TEM micrograph of the alloy structure of this material. And, FIG. 9 is a graph of the true stress-true strain curve of this material ((d) in comparison with those of the material (c) without the above heating process and of the sample material (a) fabricated by the conventional casting method. To obtain these curves, the materials (c), (d) and (a) were compressed at the room temperature with the initial strain rate: $5.5\times10^{-4}$ $S^{-1}$.

As compared, the sintered material (c) showed very high stress resistance; whereas, the material (d) showed very good ductility due to high stress resistance and high strain resistance. Moreover, although the other materials (c) and (a) fractured with increase of true strain rate as indicated respectively by cross marks in the graph of FIG. 9, the material (d) was strong enough to resist true strain rate exceeding 20 % .

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of manufacturing an intermetallic compound comprising the steps of:

mechanically alloying at least two kinds of element powders selected from a group consisting of metals and semi-metals in a non-oxidizing atmosphere in a blending machine; and heating pressurizing the mechanically alloyed powdered blend in the non-oxidizing atmosphere at a temperature higher than a minimum temperature required for generating a crystalline intermetallic compound from the element powders, thus obtaining a sintered material of the crystalline intermetallic compound.

2. A method as defined in claim 1, wherein said blending machine is a ball mill, a weight ratio between balls of said mill and the element powders to be charged into the mill being set at higher than 50 : 1.

3. A method as defined in claim 1, further comprising the step of annealing the sintered material at a temperature higher than the sintering temperature.

4. A method as defined in claim 1, wherein said pressurizing step of the blend powder is effected under a pressure higher than 100 MPa.

5. A method as defined in claim 2, wherein said element powders comprise two selected from the group consisting of Al, Mo, Nb, Ni, Si, Ti and W.

6. A method as defined in claim 1, wherein said element powders are Ti and Al and in said heating and pressurizing step, said blend is subjected to a pressure higher than 100 MPa and then to a temperature of about 900 degrees in Celsius, then, said blend being kept under 100 MPa for a predetermined time period.

7. A method as defined in claim 6, wherein said element powders comprise more than 60 wt % of Ti.

8. A method of manufacturing an intermetallic compound comprising the steps of:

mechanically alloying at least two kinds of element metal powders in a non-oxidizing atmosphere in a blending machine to produce a first powdered blend;

mechanically alloying the same two kinds of elements metal powders by a different proportion or further kinds of element metal powders in the non-oxidizing atmosphere in the blending machine to produce a second powdered blend; and heating and pressurizing said two mechanically alloyed powdered blends in the non-oxidizing atmosphere at a temperature higher than a minimum temperature required for generating a crystalline intermetallic compound from either blend, thereby obtaining a sintered material of the crystalline intermetallic compound.

9. A method as defined in claim 8, further comprising the step of annealing the sintered material at a temperature higher than the sintering temperature.

10. a method as defined in claim 1, wherein the powders are selected in a ratio which, upon heating and pressurizing the mechanically allowed powdered blend, results in a single phase of a predetermined stoichiometric composition.

11. A method as defined in claim 1, wherein the powders are selected in a ratio which, upon heating and pressurizing the mechanically allowed powdered blend, results in two or more phases of stoichiometric composition.

12. A method as defined in claim 1, wherein the powders are selected in a ratio which, upon heating and pressurizing the mechanically allowed powdered blend, results in at least one phase of a predetermined stoichiometric composition and in a non-stoichiometric composition.

* * * * *